US011739581B2

(12) United States Patent
Kashiwagi

(10) Patent No.: US 11,739,581 B2
(45) Date of Patent: Aug. 29, 2023

(54) WINDOW REGULATOR

(71) Applicant: Johnan Manufacturing Inc., Nagano (JP)

(72) Inventor: Hideaki Kashiwagi, Nagano (JP)

(73) Assignee: JOHNAN MANUFACTURING INC., Nagano (JP)

( * ) Notice: Subject to any disclaimer, the term of this patent is extended or adjusted under 35 U.S.C. 154(b) by 0 days.

(21) Appl. No.: 17/879,648

(22) Filed: Aug. 2, 2022

(65) Prior Publication Data

US 2023/0048744 A1 Feb. 16, 2023

(30) Foreign Application Priority Data

Aug. 10, 2021 (JP) ..... 2021-130949

(51) Int. Cl.
*E05F 15/00* (2015.01)
*E05D 15/16* (2006.01)

(52) U.S. Cl.
CPC ..... *E05F 15/00* (2013.01); *E05D 15/16* (2013.01); *E05Y 2201/43* (2013.01);
(Continued)

(58) Field of Classification Search
CPC ..... E05F 15/00; E05D 15/16; E05Y 2201/43; E05Y 2201/64; E05Y 2201/654;
(Continued)

(56) References Cited

U.S. PATENT DOCUMENTS 4,494,336 A * 1/1985 Ishii ..... E05F 11/486 49/374
4,502,247 A * 3/1985 Kobayashi ..... E05F 11/483 49/374

(Continued)

FOREIGN PATENT DOCUMENTS

JP 63-162085 10/1988
JP 4-032472 Y 8/1992

(Continued)

OTHER PUBLICATIONS

Office Action issued in corresponding Japanese Patent Application No. 2021-130949 dated Oct. 26, 2021; 5 pages.

(Continued)

*Primary Examiner* — Jerry E Redman
(74) *Attorney, Agent, or Firm* — Thomas W. Cole; Calderon Safran & Cole P.C.

(57) ABSTRACT

A window regulator includes a carrier plate to support a window glass of a vehicle, a guide rail along an ascending/descending direction of the window glass to slidably support the carrier plate, a wire to pull the carrier plate, a driving portion arranged at one end of the guide rail in the ascending/descending direction to drive the wire, and a turnaround portion arranged at an other end of the guide rail in the ascending/descending direction to turn the wire around. The wire arranged between the turnaround portion and the carrier plate is positioned shifted from the guide rail. The wire arranged between the driving portion and the turnaround portion is positioned on the guide rail to push and contact the guide rail.

4 Claims, 9 Drawing Sheets

(52) U.S. Cl.
CPC ..... *E05Y 2201/64* (2013.01); *E05Y 2201/654* (2013.01); *E05Y 2201/668* (2013.01); *E05Y 2201/684* (2013.01); *E05Y 2800/422* (2013.01); *E05Y 2900/55* (2013.01)

(58) Field of Classification Search
CPC ..... E05Y 2201/668; E05Y 2201/684; E05Y 2800/422; E05Y 2900/55
USPC ..... 49/352
See application file for complete search history.

(56) References Cited

U.S. PATENT DOCUMENTS

| | | | | |
|---|---|---|---|---|
| 4,663,886 | A * | 5/1987 | Nakamura | B60J 1/17 49/352 |
| 4,700,508 | A * | 10/1987 | Kollner | E05F 11/486 49/374 |
| 4,759,653 | A * | 7/1988 | Maekawa | E05F 11/486 403/360 |
| 5,033,233 | A * | 7/1991 | Suzumura | E05F 11/486 49/352 |
| 5,970,658 | A * | 10/1999 | Smith | E05F 11/382 49/352 |
| 6,088,965 | A | 7/2000 | Fukumoto et al. | |
| 7,617,633 | B2 * | 11/2009 | Shimura | E05F 11/382 49/352 |
| 9,790,728 | B2 | 10/2017 | Arimoto et al. | |
| 10,190,352 | B2 | 1/2019 | Imaoka | |
| 2018/0112451 | A1 | 4/2018 | Imaoka | |
| 2020/0131833 | A1 * | 4/2020 | Yamamoto | E05F 11/483 |

FOREIGN PATENT DOCUMENTS

| | | | |
|---|---|---|---|
| JP | 2524611 | Y | 11/1996 |
| JP | 2578881 | Y | 5/1998 |
| JP | 10-315760 | A | 12/1998 |
| JP | 2010-116761 | A | 5/2010 |
| JP | 2016-204944 | A | 12/2016 |
| JP | 2016-211335 | A | 12/2016 |
| JP | 2019-203272 | A | 11/2019 |
| JP | 2020-165087 | A | 10/2020 |

OTHER PUBLICATIONS

Decision to Grant a Patent issued in corresponding Japanese Patent Application No. 2021-130949 dated Jan. 18, 2022; 4 pages.
Notice of Dispatch of Duplicates of a Written Opposition issued in corresponding Japanese Patent Application No. 2021-130949; Description of Evidence and Statement of Opposition.
Office Action issued in corresponding Japanese Patent Application No. 2021-130949 on Oct. 26, 2021; Revised English Translation; 7 pages.
Response to Office Action issued in corresponding Japanese Patent Application No. 2021-130949 dated Oct. 26, 2021; Partial English Translation; 26 pages.

* cited by examiner

WINDOW REGULATOR

CROSS-REFERENCES TO RELATED APPLICATIONS

The present patent application claims the priority of Japanese patent application No. 2021/130949 filed on Aug. 10, 2021, and the entire contents of Japanese patent application No. 2021/130949 are hereby incorporated by reference.

TECHNICAL FIELD

The present invention relates to a window regulator.

BACKGROUND ART

A wire driving type window regulator is known in which a driving portion is arranged at a lower end of the guide rail (e.g., see Patent Literature 1). The window regulator includes a guide rail provided along the ascending/descending direction of vehicle window glass, a carrier plate that slides the guide rail and moves with a window glass, an ascending-side wire (or ascending-side cable) and a descending-side wire (or descending-side cable) that pull the carrier plate, a driving portion fixed at the lower end of the guide rail, a turnaround portion (turnaround member) arranged at an upper end of the guide rail, and a wire supporting portion (cable supporting portion) provided in middle of the guide rail in a longitudinal direction, which supports the ascending-side wire arranged between the driving portion and the turnaround member. This window regulator can prevent the ascending-side wire arranged between the driving portion and the turnaround portion from contacting a door panel, and prevent the occurrence of abnormal noise (vibration noise) from the ascending-side wire when opening/closing the door.

CITATION LIST

Patent Literature

Patent Literature 1: JP 2019/203272 A

SUMMARY OF INVENTION

The wire driving type window regulator may cause a problem that due to the wire supporting portion, the number of parts increases and the construction of the window regulator becomes complicated. Due to the increased number of parts and the complicated construction, the cost of the window regulator may increase and the weight of the window regulator may increase.

It is an object of the invention to provide a window regulator that can support the wire arranged between the driving portion and the turnaround portion without the increased number of parts and the complicated construction.

According to an aspect of the invention, a window regulator comprises:

a carrier plate to support a window glass of a vehicle;

a guide rail along an ascending/descending direction of the window glass to slidably support the carrier plate;

a wire to pull the carrier plate;

a driving portion arranged at one end of the guide rail in the ascending/descending direction to drive the wire; and a turnaround portion arranged at an other end of the guide rail in the ascending/descending direction to turn the wire around, wherein the wire arranged between the turnaround portion and the carrier plate is positioned shifted from the guide rail, and wherein the wire arranged between the driving portion and the turnaround portion is positioned on the guide rail to push and contact the guide rail.

Advantageous Effects of Invention

According to an embodiment of the present invention, a window regulator can be provided that can support the wire arranged between the driving portion and the turnaround portion without the increased number of parts and the complicated construction.

DESCRIPTION OF EMBODIMENTS

The window regulator according to an embodiment of the present invention will be explained in conjunction with appended drawings as follows. This window regulator is an ascending/descending device attached to a vehicle door, which raises and lowers a vehicle window glass. Especially, the window regulator adopts a wire supporting configuration that can support an ascending-side wire arranged between a driving portion and a pulley with a simple configuration. In the following description, an ascending/descending direction, a raising direction, and a lowering direction of the window glass will be simply referred to as the ascending/descending direction, the raising direction, and the lowering direction. In addition, in the following description, as shown in drawings, the description will be explained with defining right/left, front/rear, upper/lower. In the present embodiment, the ascending/descending direction corresponds to the upper/lower direction of the window regulator, and a vehicle width direction of vehicle corresponds to the front/rear direction of the window regulator. In addition, a direction orthogonal to the ascending/descending direction and the vehicle width direction is defined as the right/left direction of the window regulator.

(Configuration of the Vehicle Door)

Herein, a vehicle door D to which the window regulator 1 is attached will be explained with referring to FIG. 1 before the explanation of window regulator 1. The vehicle door D is provided to an automobile (vehicle). In the meantime, FIG. 1 shows the vehicle door D with omitting an outer panel described below.

Figure 1:
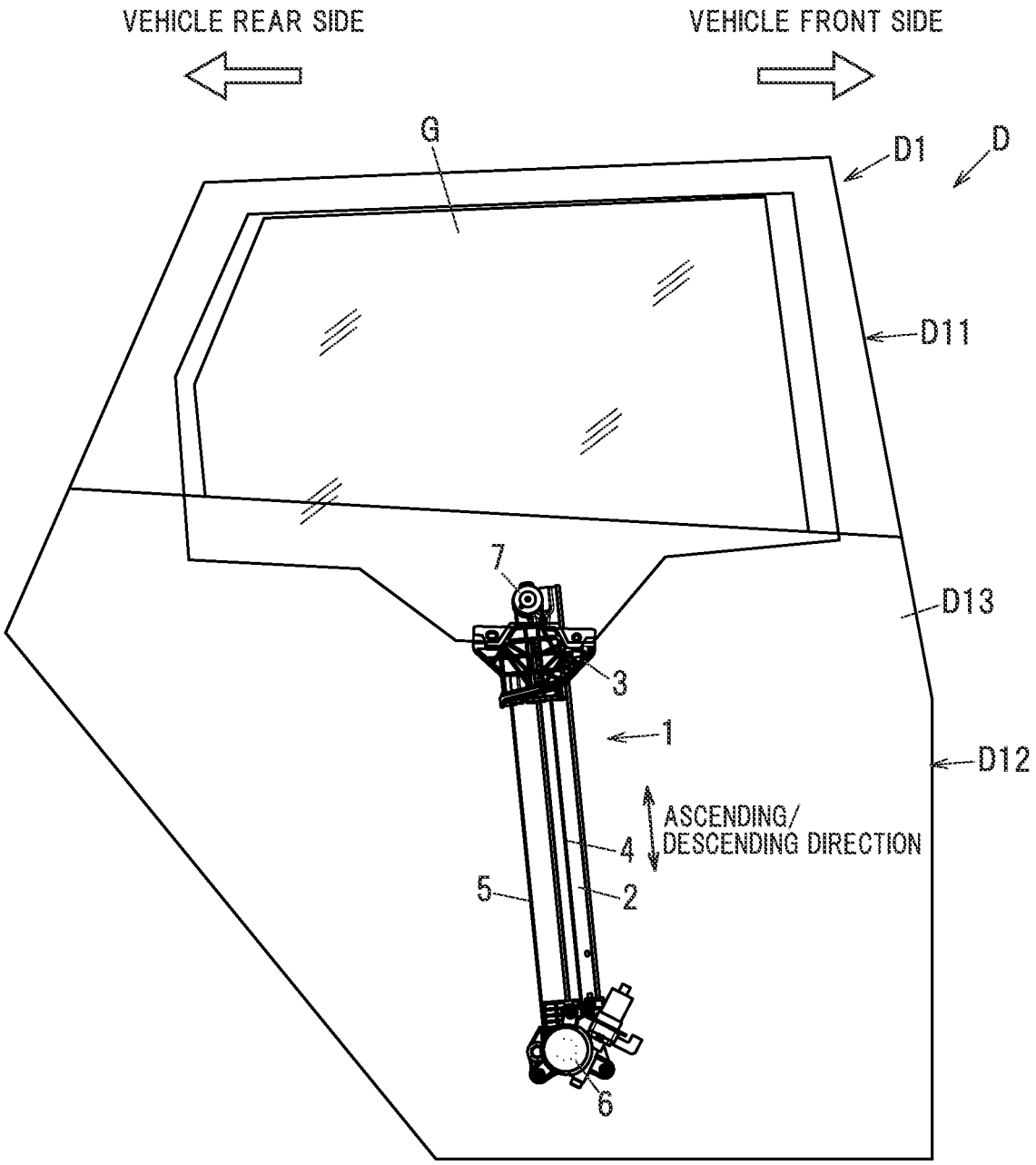
FIG. 1 is a whole schematic view showing a window regulator according to an embodiment of the present invention, and a vehicle door providing the window regulator.

As shown in FIG. 1, the vehicle door D includes a door main body D1, a vehicle window glass G supported to freely ascend and descend along a glass guide (not shown) of the door main body D1, a window regulator 1 that is attached to the door main body D1 to raise/lower the window glass G.

Figure 2:
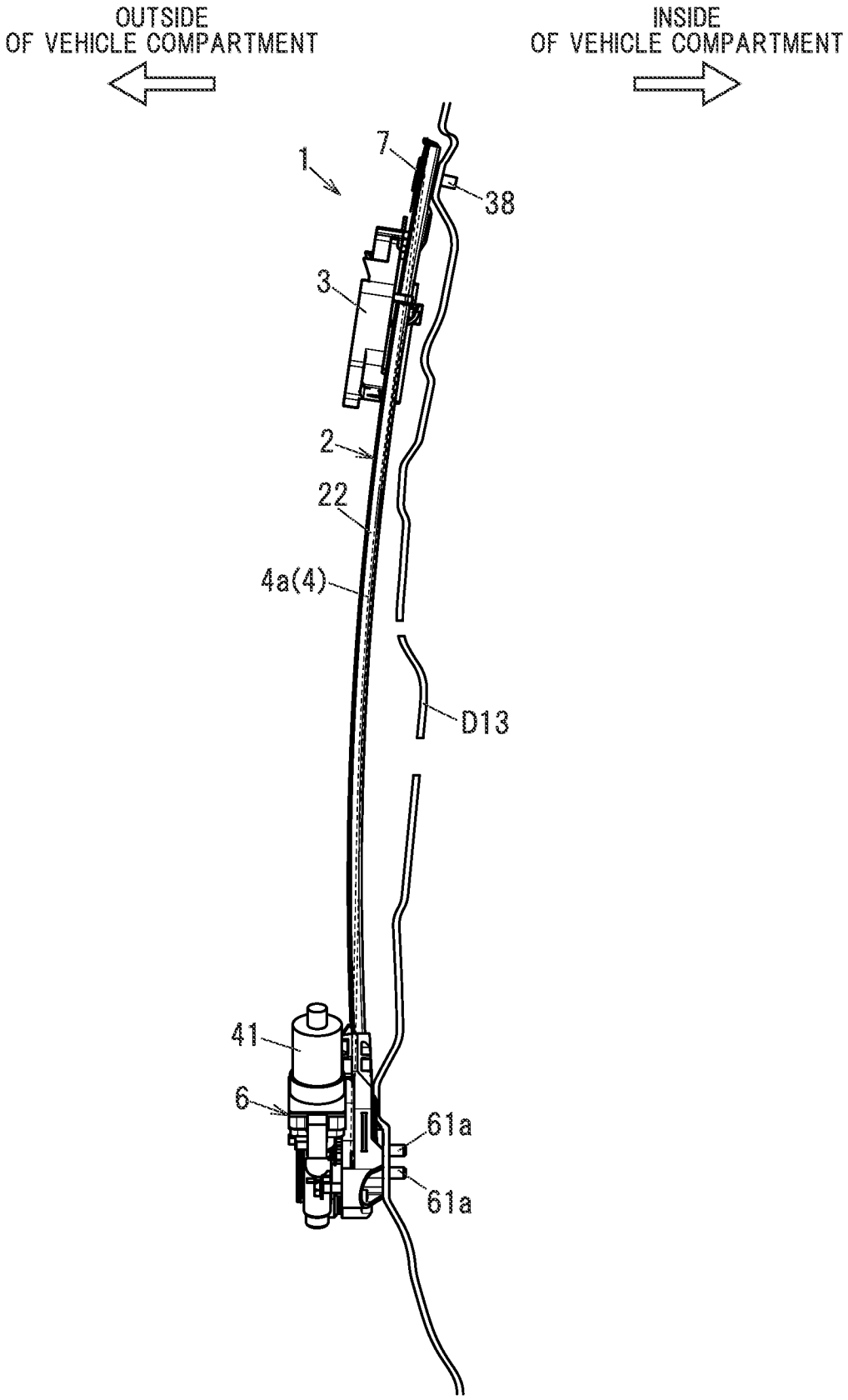
FIG. 2 is a side view showing the window regulator and an inner panel.

The door main body D1 includes a storing portion D11 storing the window glass G and a door sash D12 provided above the storing portion D11. The storing portion D11 includes an inner panel D13 serving as a door panel at an inside of the vehicle compartment, and an outer panel (not shown) at an outside of the vehicle compartment. A door inside space is defined between the inner panel D13 and the outer panel. As shown in FIG. 2, the window regulator 1 is attached to the inner panel D13 in the door inside space. In addition, as shown in FIG. 1, the window regulator 1 is attached with inclining to a rear side of vehicle front/rear direction to the door main body D1.

(Configuration of the Window Regulator)

Figure 3C:
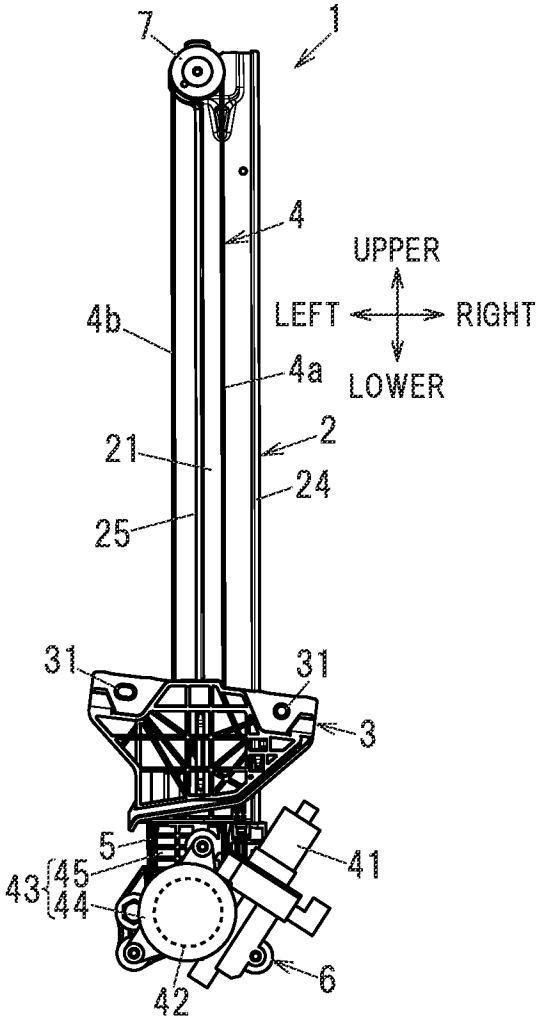
FIG. 3C is a front view showing the window regulator when the window glass is fully-opened.
Figure 3B:
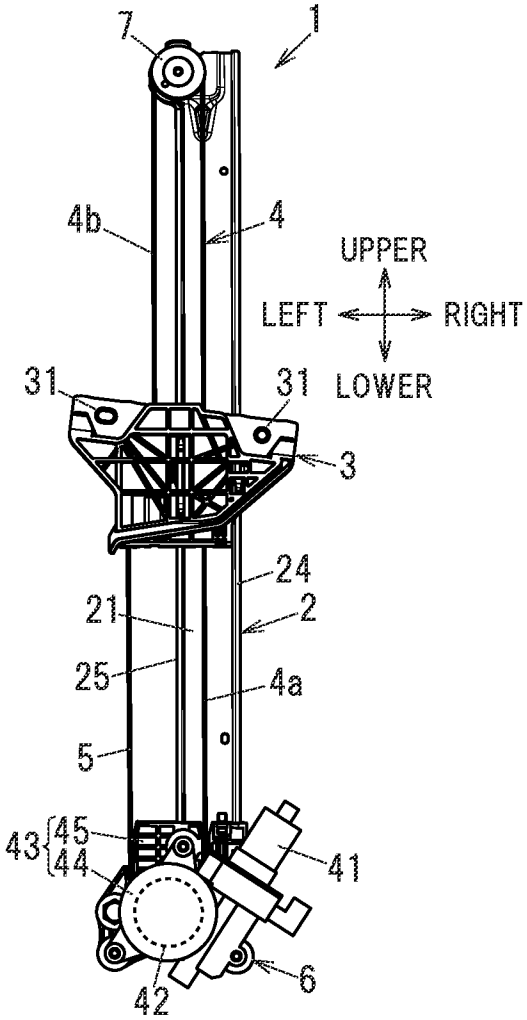
FIG. 3B is a front view showing the window regulator when the window glass is partly-opened.
Figure 3A:
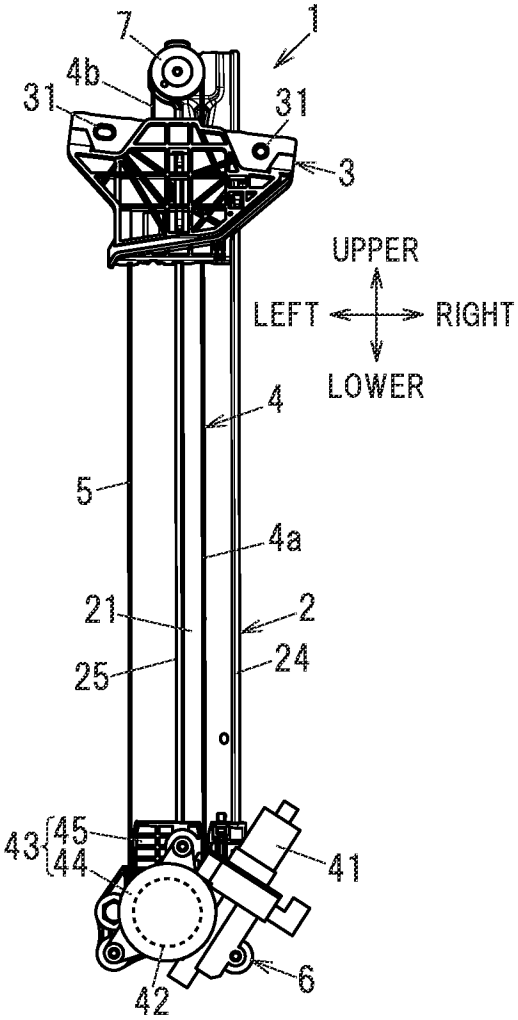
FIG. 3A is a front view showing the window regulator when a window glass is fully-closed.

As shown in FIGS. 3A to 3C, the window regulator 1 includes a guide rail 2 provided along the ascending/descending direction, a carrier plate 3 that supports the window glass G and is slidably attached to the guide rail 2, an ascending-side wire 4 (wire) and a descending-side wire 5 that pull the carrier plate 3, and ascend/descend the carrier plate 3 along the guide rail 2, a driving portion 6 that is arranged at the lower end of the guide rail 2 (one end in the ascending/descending direction) and drives the ascending-side wire 4 and the descending-side wire 5, and a pulley 7 (turnaround portion) that is arranged at an upper end of the guide rail 2 (other end in the ascending/descending direction) and turns the ascending-side wire 4 around.

In addition, as shown in FIGS. 4A to 4D, the window regulator 1 includes an ascending-side sliding bush 11 attached to a carrier plate 3 side end of the ascending-side wire 4, an ascending-side spring 12 providing tension to the ascending-side wire 4 through the ascending-side sliding bush 11, a descending-side sliding bush 13 attached to a carrier plate 3 side end of the descending-side wire 5, and a descending-side spring 14 providing tension to the ascending-side wire 4 through the descending-side sliding bush 13. That is, the window regulator 1 serves as a wire driving window regulator that ascends/descends the carrier plate 3 by using the wires 4, 5, and is a lower end rail type window regulator arranging the driving portion 6 at the lower end of the guide rail 2.

As shown in FIG. 2, the guide rail 2 is a long-ranged metal member extended along the ascending/descending direction. The upper end of the guide rail 2 is fixed to the inner panel D13, and the lower end thereof is fixed to the driving portion 6 (a drum housing 44 of the driving portion 6). In addition, the guide rail 2 is curved to protrude toward a vehicle exterior direction in the vehicle width.

As shown in FIGS. 4A to 4D, the guide rail 2 includes a flat-plate portion 21 extended in the ascending/descending direction, a right side-plate portion 22 and a left side-plate portion 23 that are stand toward a front side from right/left ends in a short end direction of the flat-plate portion 21 (a direction orthogonal to the ascending/descending direction), a right flange portion 24 extended to a right side from a front end of the right side-plate portion 22, and a left flange portion 25 extended to a left side from a front end of the left side-plate portion 23. The guide rail 2 slidably supports the carrier plate 3 by the left side-plate portion 23.

As shown in FIGS. 3A to 3C, one end of the ascending-side wire 4 is connected to a rotating drum 42 (described below) of the driving portion 6 and the other end thereof is connected to the carrier plate 3 when the ascending-side wire 4 is fed out upward and reaches to the pulley 7 and is then turned around downward by the pulley 7. In the meantime, one end of the descending-side wire 5 is connected to the rotating drum 42 of the driving portion 6 and is fed out from the driving portion 6, and the other end thereof is attached to the carrier plate 3.

In addition, an ascending-side wire 4*a* arranged between the driving portion 6 and the pulley 7 from the ascending-side wire 4 is positioned on the flat-plate portion 21 of the guide rail 2 and is overlapped on the flat-plate portion 21 of the guide rail in viewed from the vehicle width direction (a rotational axis direction of the rotating drum 42). As described above, since the guide rail 2 is curved toward the vehicle width direction, the ascending-side wire 4*a* arranged between the driving portion 6 and the pulley 7 to push and contact a middle portion in the upper/lower direction of the flat-plate portion 21 of the guide rail 2 (see e.g., FIG. 2). Hereby, the flat-plate portion 21 of the guide rail 2 serves as a wire supporting configuration supporting the ascending-side wire 4*a* arranged between the driving portion 6 and the pulley 7 at the middle portion in the upper/lower direction. In the meantime, the ascending-side wire 4*b* arranged between the pulley 7 and the carrier plate 3 from the ascending-side wire 4 and the descending-side wire 5 are positioned at a position shifted from the guide rail 2. The ascending-side wire 4*b* and the descending-side wire 5 are shifted from the guide rail 2 in a right/left direction in viewed from the vehicle width direction (the rotational axis direction of the rotating drum 42).

As shown in FIGS. 4A to 4D and 5A to 5C, the carrier plate 3 is a plate-shaped member formed of resins such as polyacetal, and the carrier plate 3 is arranged to face the flat-plate portion 21 of the guide rail 2. Two right and left attaching holes 31 to attach the window glass G, a rail attaching portion 32 arranged at a center in a right/left direction of a rear surface side (back side in FIGS. 4A to 4C), an ascending-side housing portion 33 arranged at a left side of the rail attaching portion 32, a descending-side housing portion 34 arranged at a left side of ascending-side housing portion 33, a notch portion 35 avoiding the ascending-side wire 4*a* on the flat-plate portion 21 of the guide rail 2, which is arranged at a right side of the rail attaching portion 32 in a rear surface side, and a contacted portion 36 on which a position regulating portion 64 of the driving portion 6 is contacted, and which is arranged at a right side lower end of the notch portion 35.

The attaching holes 31 are for bolt fasting a glass holder (not shown) fixed on the window glass G. The window glass G is attached to the carrier plate 3 through the glass holder by fasting the glass holder to the attaching holes 31 by bolts.

The rail attaching portion 32 is slidably attached to the left side-plate portion 23 of the guide rail 2. That is, the rail attaching portion 32 is supported to freely ascend and descend by the left side-plate portion 23 of the guide rail 2.

As shown in FIG. 4, the ascending-side housing portion 33 houses the ascending-side sliding bush 11 and the ascending-side spring 12. Hereby, a carrier plate 3 side end of the ascending-side wire 4 is attached to the ascending-side housing portion 33 through the ascending-side sliding bush 11 and the ascending-side spring 12. In the meantime, the descending-side housing portion 34 houses the descending-side sliding bush 13 and the descending-side spring 14. Hereby, a carrier plate 3 side end of the descending-side wire 5 is attached to the descending-side housing portion 34 through the descending-side sliding bush 13 and the descending-side spring 14.

The notch portion 35 is extended in the ascending/descending direction such that the carrier plate 3 does not contact the ascending-side wire 4*a* arranged between the driving portion 6 and the pulley 7. Since disjunction of the ascending-side wire 4*a* arranged between the driving portion 6 and the pulley 7 against the guide rail 2 is different depending on a position on the guide rail 2 in the ascending/descending direction, as shown in FIG. 4C, a depth of the notch portion 35 in the front/rear direction is a depth such that the ascending-side wire 4*a* does not contact the carrier plate 3 even when the carrier plate 3 is located at an upper end position of the guide rail 2 where the ascending-side wire 4*a* is the farthest from the guide rail 2 (when the window glass G is fully-closed).

Figure 4A:
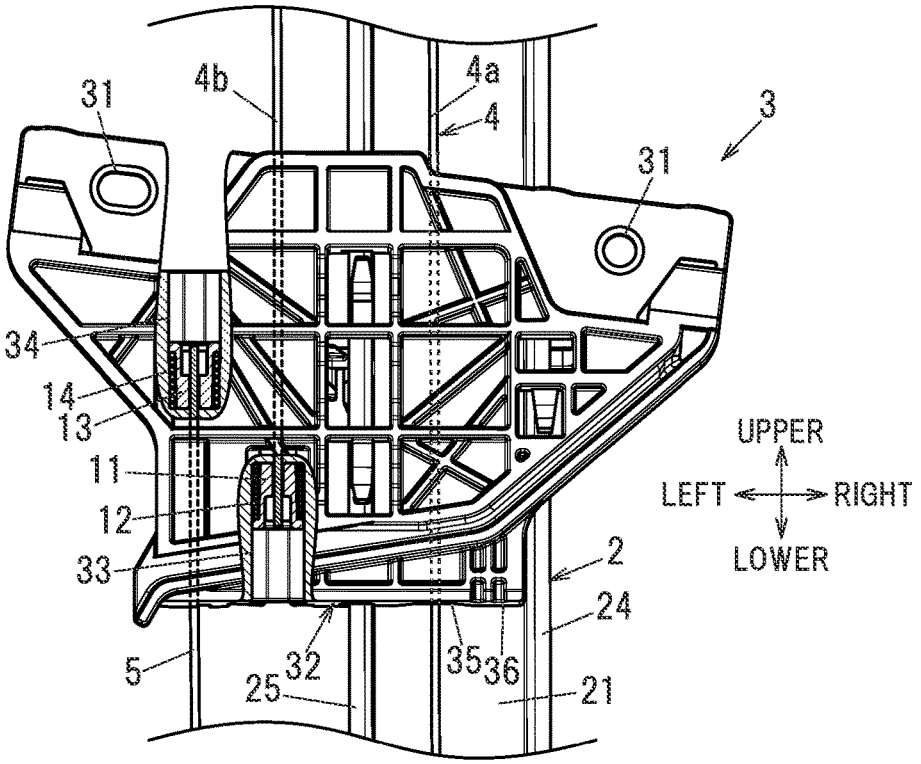
FIG. 4A is a front view showing a periphery of a carrier plate.
Figure 4B:
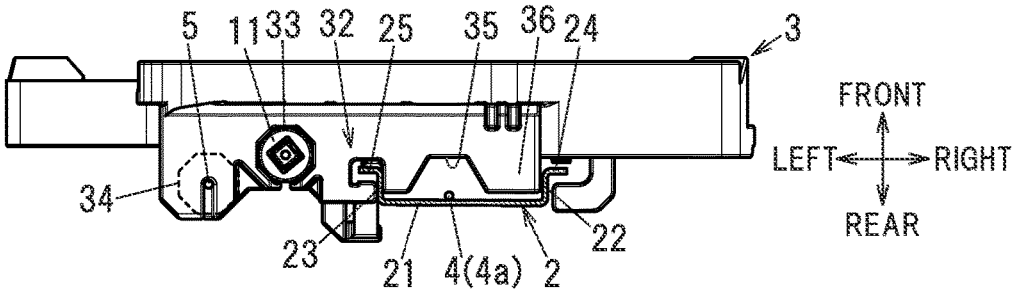
FIG. 4B is a bottom view showing a periphery of the carrier plate when the window glass is partly-opened.
Figure 4C:
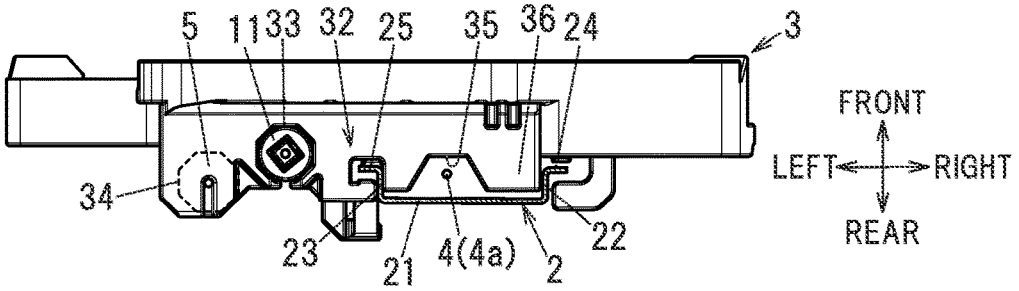
FIG. 4C is a bottom view showing a periphery of the carrier plate when the window glass is fully-closed.
Figure 4D:
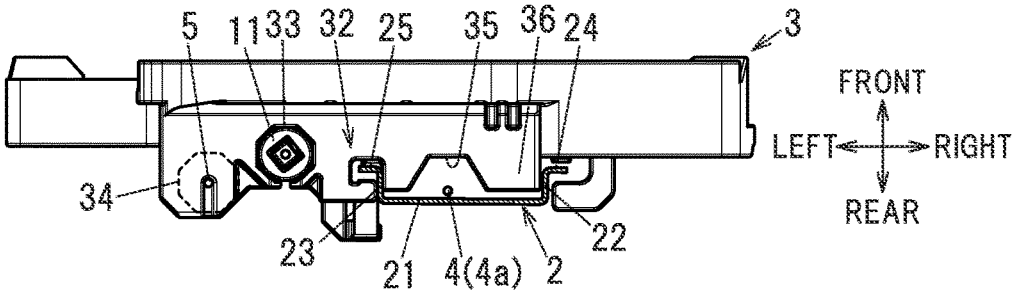
FIG. 4D is a bottom view showing a periphery of the carrier plate when the window glass is fully-opened.
Figure 5A:
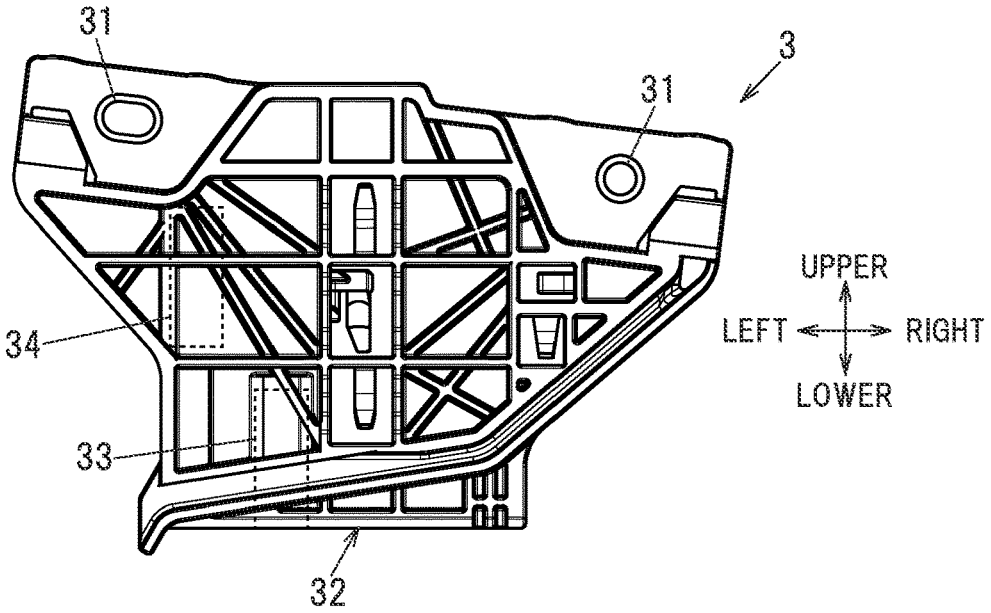
FIG. 5A is a front view showing the carrier plate.
Figure 5B:
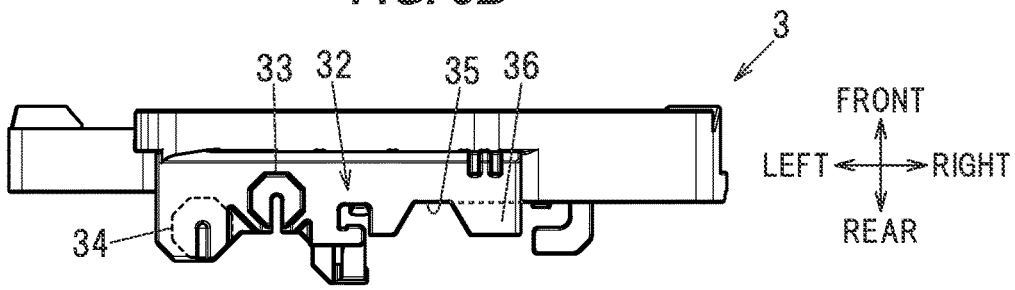
FIG. 5B is a bottom view showing the carrier plate.
Figure 5C:
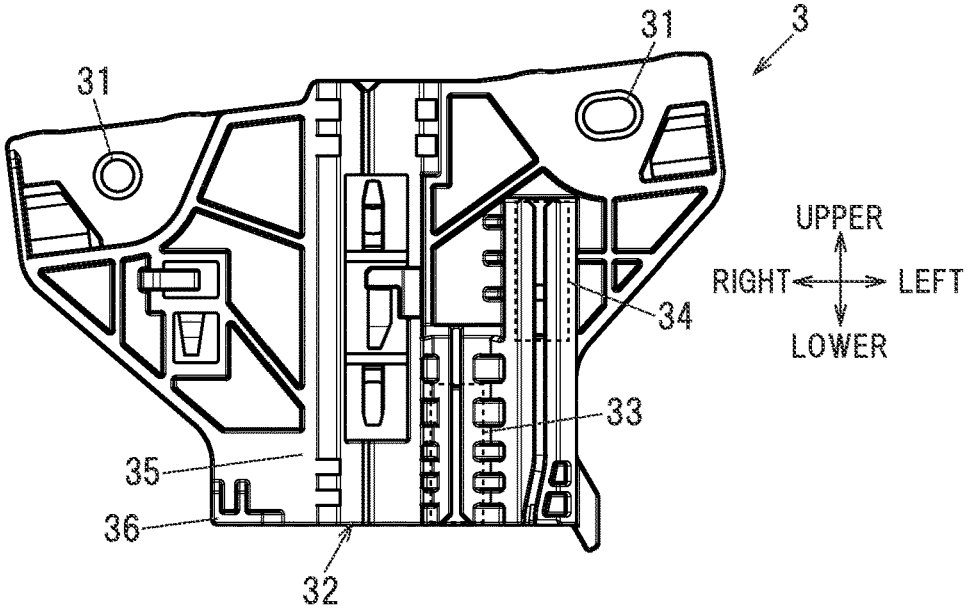
FIG. 5C is a rear view showing the carrier plate.

Further, as shown in FIG. 4D, the ascending-side wire 4*a* located at a lower end position of the guide rail 2 where the carrier plate 3 when the window glass G is fully-opened faces is arranged to be closer to the guide rail 2 than the ascending-side wire 4*a* located at the upper end position of the guide rail 2 shown in FIG. 4C. It is because a wire feeding out position P1 of the rotating drum 42 is located to be closer to the guide rail 2 in the vehicle width direction than the wire feeding out position of the pulley 7.

Figure 6A:
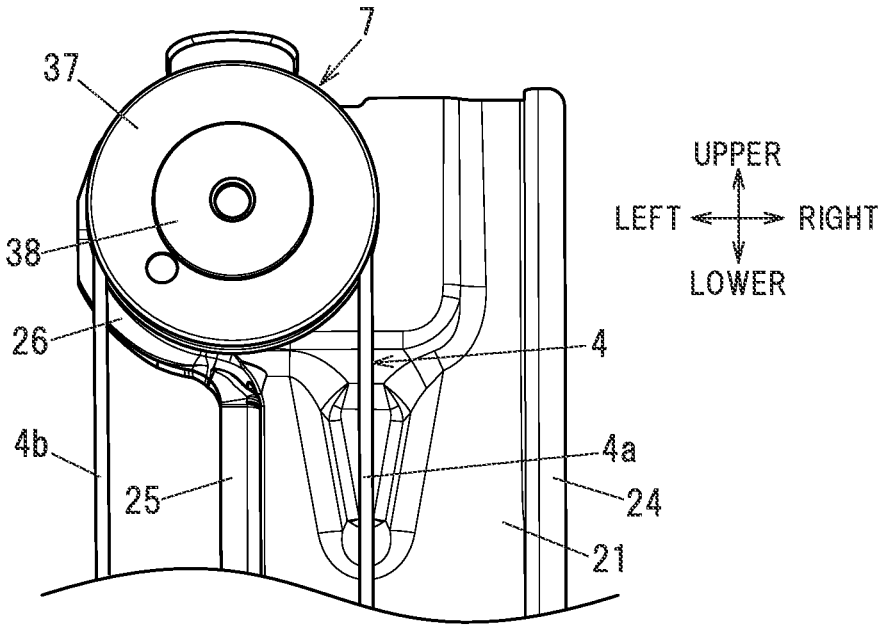
FIG. 6A is a front view showing a periphery of a pulley.
Figure 6B:
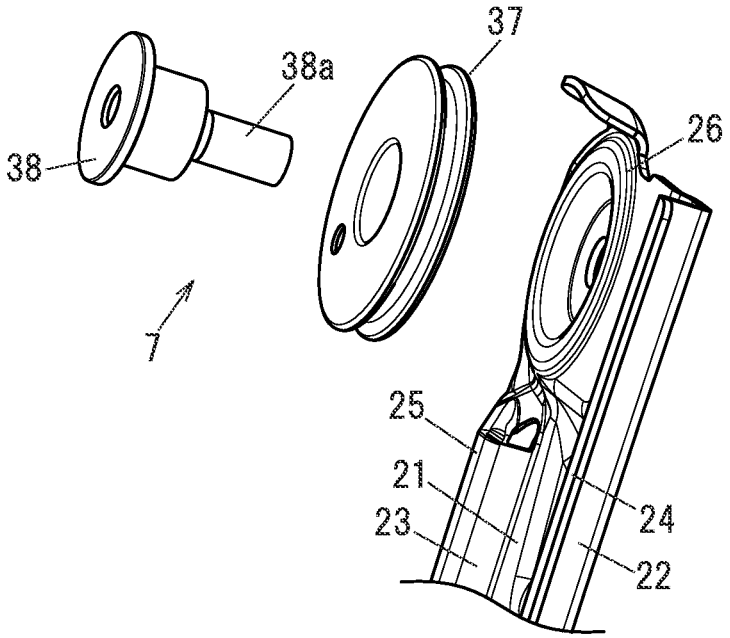
FIG. 6B is an exploded perspective view showing a periphery of the pulley.

As shown in FIGS. 6A and 6B, the pulley 7 includes a pulley main body 37 winding and turning the ascending-side wire 4 around, a pulley shaft 38 rotatably supporting the pulley main body 37.

The pulley shaft 38 is fixed on a pulley supporting portion 26 arranged on the upper end of the guide rail 2 to pass through the pulley supporting portion 26. In addition, a bolt portion 38*a* to be fixed to the inner panel D13 is formed at a tip end (rear end) of the pulley shaft 38. Thus, as shown in FIG. 2, the upper end of the guide rail 2 is fixed to the inner panel D13 by the pulley shaft 38.

Figure 7A:
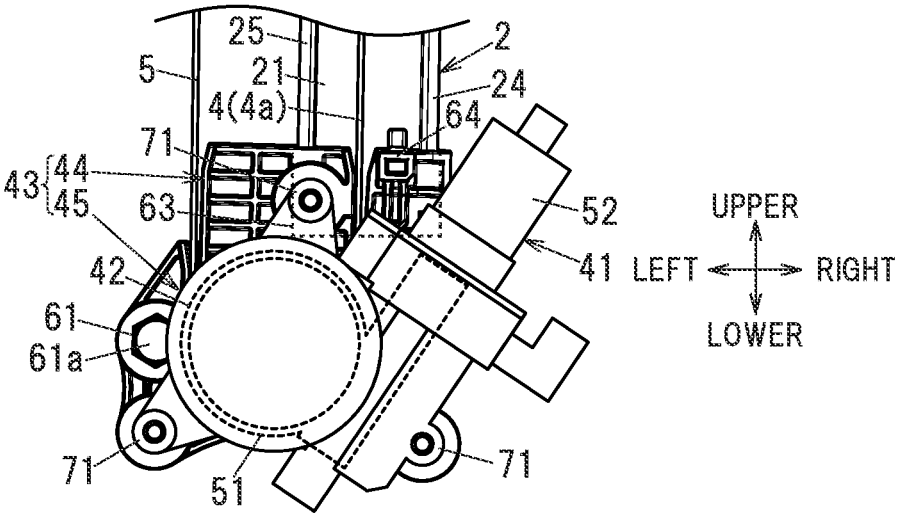
FIG. 7A is a front view showing a periphery of a driving portion.
Figure 7B:
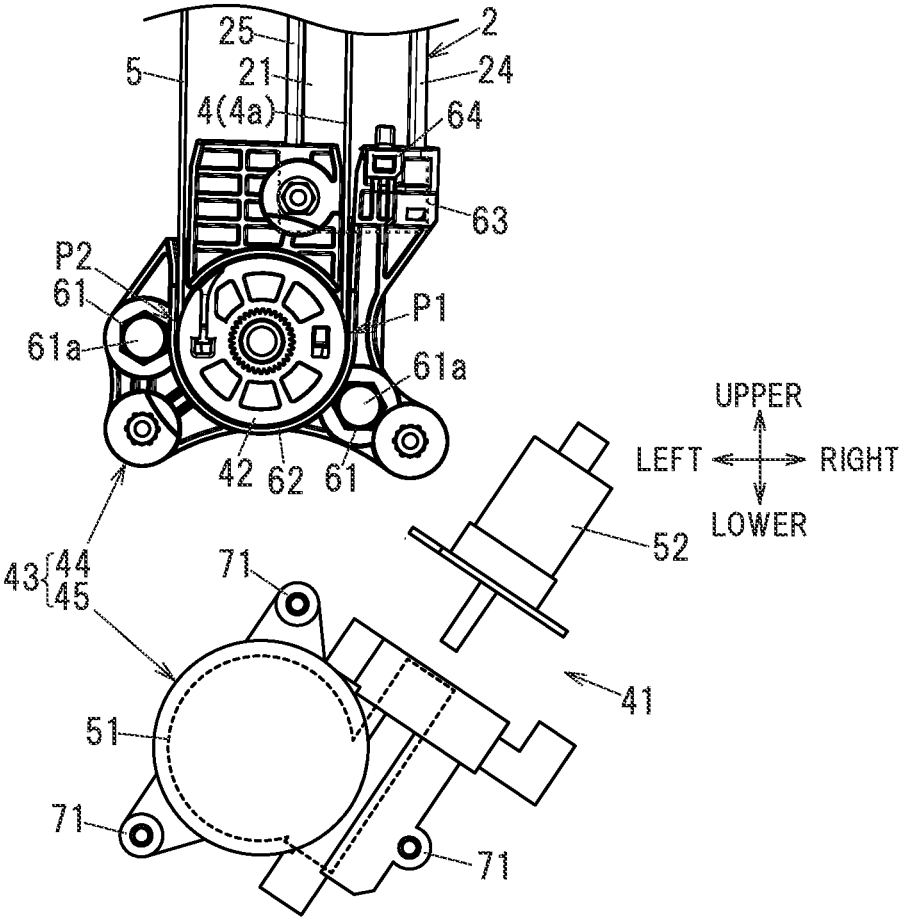
FIG. 7B is an exploded view showing a periphery of the driving portion.
Figure 8:
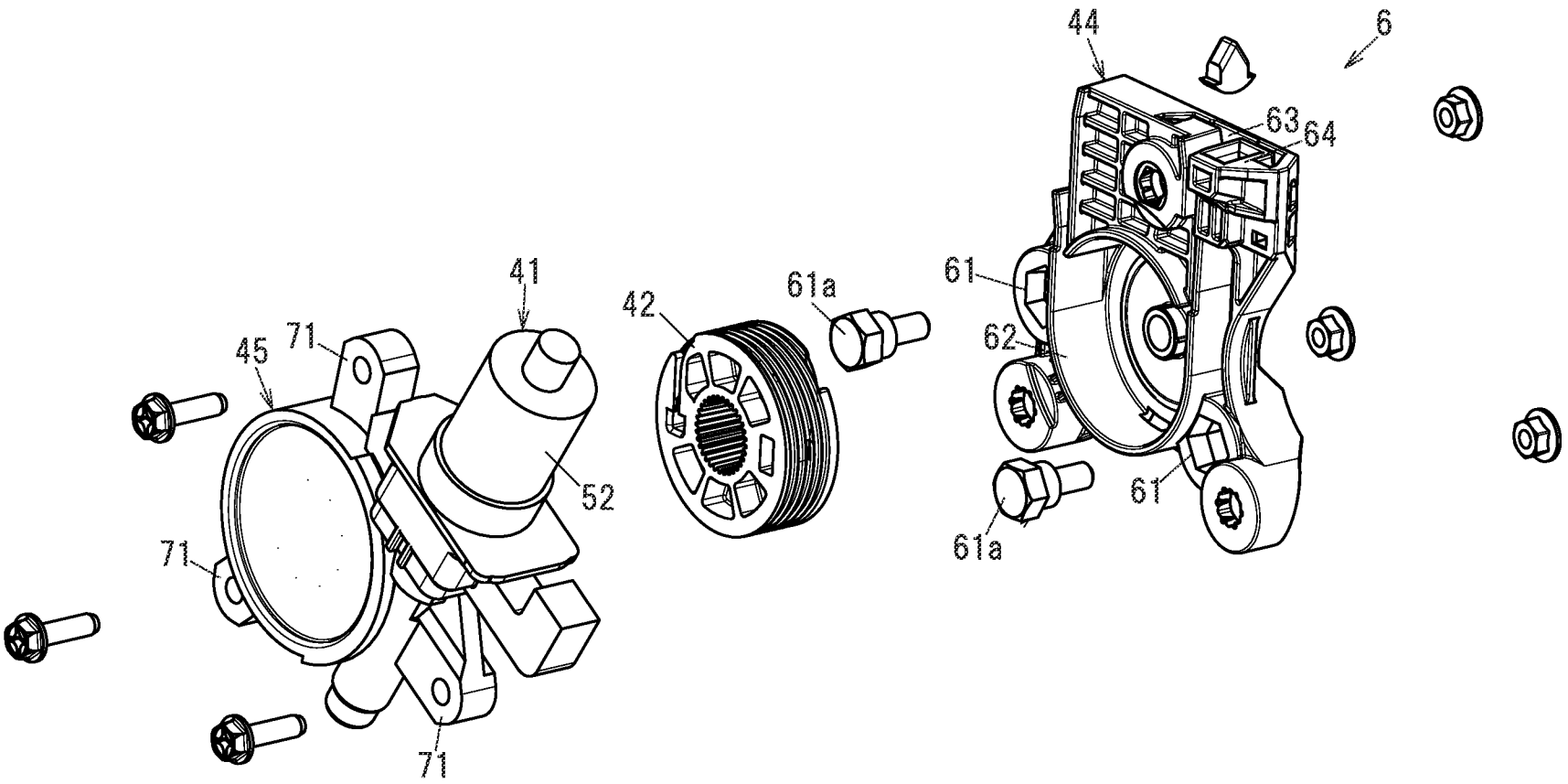
FIG. 8 is an exploded perspective view showing the driving portion.

As shown in FIGS. 7A to 8, the driving portion 6 includes a driving motor 41 having a reducer 51, which can forward/reverse rotationally drive, a rotating drum 42 rotationally driven by the driving motor 41, and a housing 43 to house the rotating drum 42 and hold the driving motor 41. The housing 43 includes a drum housing 44 that fits the lower end of the guide rail 2 and rotatably houses the rotating drum 42, and a motor housing 45 to hold the driving motor 41.

Driving portion 6 side ends of the ascending-side wire 4 and the descending-side wire 5 are connected to the rotating drum 42. The ascending-side wire 4 and the descending-side wire 5 are took up and fed out by rotating the rotating drum 42. In addition, the rotating drum 42 is configured to feed out the ascending-side wire 4 from a right-side wire feeding out position P1 and the descending-side wire 5 from a left-side wire feeding out position P2. The right-side wire feeding out position P1 of the rotating drum 42 (the wire feeding out position of the ascending-side wire 4) is overlapped with the guide rail 2 in the right/left direction (an orthogonal direction orthogonal to the ascending/descending direction). In the meantime, the left-side wire feeding out position P2 of the rotating drum 42 (the wire feeding out position of the descending-side wire 5) shifts from the guide rail 2 in the right/left direction. Hereby, only the ascending-side wire 4*a* fed out from the right-side wire feeding out position P1 of the rotating drum 42 to the pulley 7 from the ascending-side wire 4*a* fed out from the right-side wire feeding out position P1 of the rotating drum 42 and the descending-side wire 5 fed out from the left-side wire feeding out position P2 of the rotating drum 42 to the carrier plate 3 is configured to overlap the guide rail 2.

The driving motor 41 includes the reducer 51 enclosed in the motor housing 45 and rotatably attaching the rotating drum 42 to an output axis, and a yoke portion 52 (motor main body) arranged to be adjacent to a right-side of the reducer 51 and rotating the rotating drum 42 through the reducer 51.

When the driving motor 41 is forward driven, the rotating drum 42 forward rotates and the descending-side wire 5 is fed out and the ascending-side wire 4 is wound in accordance with the rotation. Hereby, the carrier plate 3 is pulled by the ascending-side wire 4 and moves in the raising direction. Thus, the window glass G attached to the carrier plate 3 ascends (ascending movement of the window glass G). In the meantime, when the driving motor 41 is reverse driven, the rotating drum 42 reverses and the ascending-side wire 4 is fed out and the descending-side wire 5 is wound in accordance with the rotation. Hereby, the carrier plate 3 is pulled by the descending-side wire 5 and moves in the lower direction. Thus, the window glass G attached to the carrier plate 3 descends (descending movement of the window glass G). Therefore, the carrier plate 3 and the window glass G are ascended/descended along the guide rail 2 by such configuration.

Two fixing holes 61 to fix the drum housing 44 to the inner panel D13 by bolts 61*a*, a drum housing portion 62 to house the rotating drum 42, a fitting hole 63 arranged at upper right of the drum housing portion 62 and fitting the lower end of the guide rail 2, and a position regulating portion 64 arranged at a front side of the fitting hole 63 (front side in FIG. 7A). The position regulating portion 64 regulates moving the carrier plate 3 to lower end by contacting the contacted portion 36 of the carrier plate 3 when the window glass G is fully-opened.

The fitting hole 63 fits to the lower end portion of the guide rail 2. The lower end portion of the guide rail 2 is fixed to the drum housing 44 by the fitting hole 63. Since the fitting hole 63 is arranged to the right-side wire feeding out position P1 of the rotating drum 42 housed in the drum housing portion 62 in the right/left direction (a direction orthogonal to the ascending/descending direction and the vehicle width direction), the guide rail 2 fit to the fitting hole 63 is arranged to overlap the right-side wire feeding out position P1 of the rotating drum 42 in the right/left direction. Thus, the guide rail 2 is configured to overlap the ascending-side wire 4*a* fed out from the right-side wire feeding out position P1 to the pulley 7 in the right/left direction. Hereby, the guide rail 2 can close to the yoke portion 52 of the driving motor 41 as possible.

The motor housing 45 includes the reducer 51 and covers an opening of the drum housing portion 62 of the drum housing 44 while rotatably attaching the output axis of the reducer 51. In addition, three fixing portions 71 to fix the motor housing 45 to the drum housing 44 is formed in the motor housing 45. In the meantime, a part of the three fixing portions 71 is arranged at a position overlapped with the guide rail 2 in the right/left direction.

Effects of the Embodiment

According to the configuration in the above embodiment, since the ascending-side wire 4*a* arranged between the driving portion 6 and the pulley 7 is configured to be located on the guide rail 2, it is possible to serve the guide rail 2 as a wire supporting portion to support the ascending-side wire 4*a* at a middle portion in the ascending/descending direction. Thus, it is possible to support the ascending-side wire 4*a* by the simple configuration without attaching a separate wire supporting portion. That is, it is possible to prevent the ascending-side wire 4*a* from contacting the inner panel D13 and prevent the occurrence of abnormal noise (such as vibration noise) when opening/closing the door.

In addition, according to the configuration in the above embodiment, since only the ascending-side wire 4*a* arranged between the driving portion 6 and the pulley 7 among the ascending-side wire 4*a*, the ascending-side wire 4*b* and the descending-side wire 5 is configured to be poisoned on the guide rail 2, it is possible to decrease width (width in the right/left direction) of the guide rail 2. Thus, the weight of the window regulator 1 can further reduce.

In addition, according to the configuration in the above embodiment, it is possible to prevent the occurrence of hitting sound by contacting the ascending-side wire 4*b* arranged between the pulley 7 and the carrier plate 3 with the guide rail 2 by locating the ascending-side wire 4*a* arranged between the driving portion 6 and the pulley 7, and locating the ascending-side wire 4*b* arranged between the pulley 7 and the carrier plate 3 at a position shifted from the guide rail 2. That is, when a configuration that locates both the ascending-side wire 4*a* arranged between the driving portion 6 and the pulley 7, and the ascending-side wire 4*b* arranged between the pulley 7 and the carrier plate 3 on the guide rail 2 is adopted, the ascending-side wire 4*a* arranged between the driving portion 6 and the pulley 7 can constantly push and contact the guide rail 2 regardless ascending/descending position of the carrier plate 3. However, the ascending-side wire 4*b* arranged between the pulley 7 and the carrier plate 3 is slightly separated from the guide rail 2 in some ascending/descending position of the carrier plate 3. If the ascending-side wire 4*b* is slightly separated from the guide rail 2, the ascending-side wire 4*b* swings in the vehicle width direction and hardly contacts the guide rail 2, and thus the hitting sound occurs when opening/closing the vehicle door D. In the meantime, according to the configuration in the above embodiment, it is possible to prevent from swinging the ascending-side wire 4*b* in the vehicle width direction and hardly contacting the guide rail 2, and thus prevent the occurrence of hitting sound when opening/closing the vehicle door D by locating the ascending-side wire 4*b* arranged between the pulley 7 and the carrier plate 3 at the position shifted from the guide rail 2. That is, in the above embodiment, with the ascending-side wire 4*a* arranged between the driving portion 6 and the pulley 7, the abnormal noise when opening/closing the vehicle door D can be prevented by positioning the wire 4*a* on the guide rail 2 such that the wire 4*a* is pushed and contacted against the guide rail 2, and with the ascending-side wire 4*b* arranged between the pulley 7 and the carrier plate 3, the abnormal noise when opening/closing the vehicle door D can be prevented by positioning the wire 4*b* to be shifted from the guide rail 2 such that the wire 4*b* is disposed not to overlap the guide rail 2 when viewed in the vehicle width direction.

In addition, according to the configuration in the above embodiment, even when the carrier plate 3 moves to any positions in the ascending/descending direction, the carrier plate 3 does not contact the ascending-side wire 4*a* pushed and contacted on the guide rail 2 by providing the notch portion 35 to the carrier plate 3. Thus, it is possible to contact the ascending-side wire 4*a* to the guide rail 2 without any interferences. That is, the carrier plate 3 does not interfere when the ascending-side wire 4*a* pushes and contacts the guide rail 2.

Other Embodiments

Although the embodiment of the invention has been described, the invention according to claims is not to be limited to the embodiment described above. Further, please note that all combinations of the features described in the embodiment are not necessary to solve the problem of the invention. The invention can be appropriately modified and implemented without departing from the gist thereof.

Figure 9A:
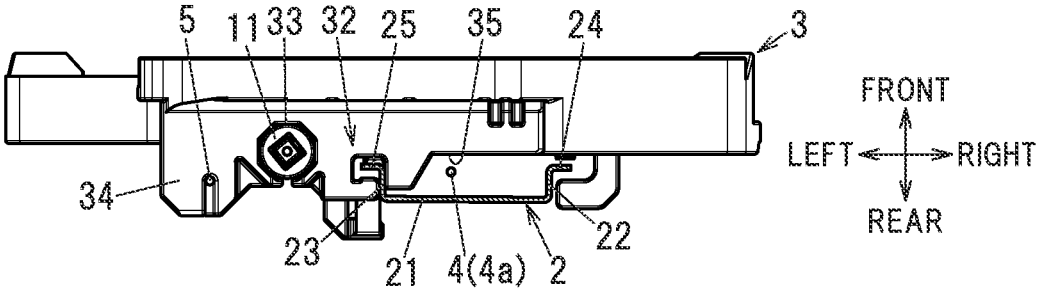
FIG. 9A is a bottom view showing a periphery of a carrier plate in the first variation when the window glass is fully-closed.
Figure 9B:
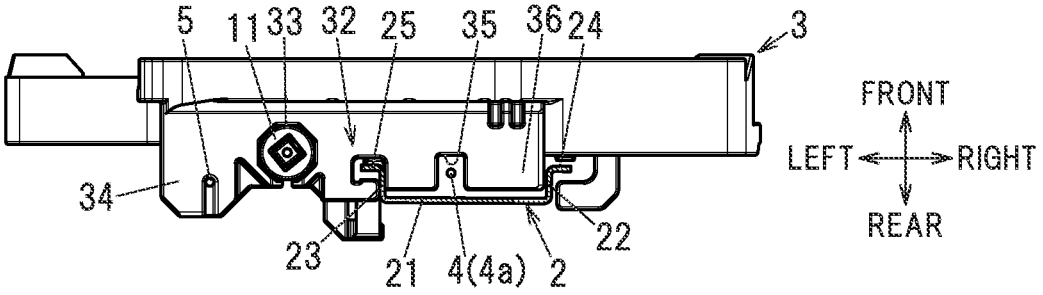
FIG. 9B is a bottom view showing a periphery of a carrier plate in the second variation when the window glass is fully-closed.

For example, although the above embodiment has a configuration that partially narrows a width of the notch portion 35 by the contacted portion 36, as shown in FIG. 9A, the contacted portion 36 may be omitted. In addition, as shown in FIG. 9B, the notch portion 35 may be formed in a rectangular shape in viewed from the upper/lower direction (ascending/descending direction).

REFERENCE SIGNS LIST

1 WINDOW REGULATOR
2 GUIDE RAIL
3 CARRIER PLATE
4 ASCENDING-SIDE WIRE
4*a* ASCENDING-SIDE WIRE ARRANGED BETWEEN PULLEY AND DRIVING PORTION
6 DRIVING PORTION
7 PULLEY
21 FLAT-PLATE PORTION
22 RIGHT SIDE-PLATE PORTION
23 LEFT SIDE-PLATE PORTION
35 NOTCH PORTION
G WINDOW GLASS

The invention claimed is:

1. A window regulator, comprising:

a carrier plate to support a window glass of a vehicle;

a guide rail along an ascending/descending direction of the window glass to slidably support the carrier plate;

a wire to pull the carrier plate;

a driving portion arranged at one end of the guide rail in the ascending/descending direction to drive the wire; and a turnaround portion arranged at another end of the guide rail in the ascending/descending direction to turn the wire around, wherein the guide rail comprises a flat-plate portion extended along the ascending/descending direction and a side-plate portion standing from an end of the flat-plate portion in a direction orthogonal to the ascending/descending direction, wherein a portion of the wire arranged between the turnaround portion and the carrier plate is positioned as to not overlap the guide rail as viewed from the vehicle width direction of the vehicle, wherein a portion of the wire arranged between the driving portion and the turnaround portion is positioned on the flat-plate portion, and wherein the portion of the wire arranged between the driving portion and the turnaround portion is pushed toward and contacts the flat-plate portion.

2. The window regulator according to claim 1, wherein the carrier plate is arranged to face the flat-plate portion and wherein a notch portion to avoid the wire is formed in the carrier plate.

3. A window regulator, comprising:

a carrier plate to support a window glass of a vehicle;

a guide rail along an ascending/descending direction of the window glass to slidably support the carrier plate;

a wire to pull the carrier plate;

a driving portion arranged at one end of the guide rail in the ascending/descending direction to drive the wire; and a turnaround portion arranged at another end of the guide rail in the ascending/descending direction to turn the wire around, wherein the guide rail comprises a flat-plate portion extended along the ascending/descending direction and a side-plate portion standing from an end of the flat-plate portion in a direction orthogonal to the ascending/descending direction, wherein a portion arranged between the turnaround portion and the carrier plate of the wire is positioned so as to not overlap the guide rail as viewed from the vehicle width direction of the vehicle, wherein a portion arranged between the driving portion and the turnaround portion of the wire is positioned on the guide rail, and wherein the portion of the wire arranged between the driving portion and the turnaround portion is pushed toward and contacts the guide rail at a base end of the side-plate portion in the vehicle width direction of the vehicle.

4. The window regulator according to claim 3, wherein the portion arranged between the driving portion and the turnaround portion of the wire is positioned on the flat-plate portion.

* * * * *